US009784227B2

(12) United States Patent
Uchiyama

(10) Patent No.: US 9,784,227 B2
(45) Date of Patent: Oct. 10, 2017

(54) FUEL INJECTION SYSTEM

(75) Inventor: Tomoyuki Uchiyama, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 97 days.

(21) Appl. No.: 14/416,756

(22) PCT Filed: Jul. 25, 2012

(86) PCT No.: PCT/JP2012/068861
§ 371 (c)(1),
(2), (4) Date: Jan. 23, 2015

(87) PCT Pub. No.: WO2014/016920
PCT Pub. Date: Jan. 30, 2014

(65) Prior Publication Data
US 2015/0219050 A1 Aug. 6, 2015

(51) Int. Cl.
*F02M 53/06* (2006.01)
*F02M 61/04* (2006.01)
*F02M 53/02* (2006.01)
*F02M 31/125* (2006.01)

(52) U.S. Cl.
CPC ..... *F02M 53/06* (2013.01); *F02M 53/02* (2013.01); *F02M 61/04* (2013.01); *F02M 31/125* (2013.01)

(58) Field of Classification Search
CPC ..... F02M 53/06; F02M 53/02; F02M 61/04; F02M 31/125
USPC ..... 123/689, 464, 512, 513, 541, 543, 549, 123/557, 555, 558; 701/101, 103, 104; 239/585.1, 135, 139, 132.1, 132.3, 133, 239/136, 584
See application file for complete search history.

(56) References Cited

U.S. PATENT DOCUMENTS 5,649,515 A * 7/1997 Fuchs ..... F02M 31/125 123/557
7,677,468 B2 * 3/2010 Hornby ..... F02M 31/125 123/549
8,884,198 B2 * 11/2014 Czimmek ..... F02M 53/06 219/628
9,074,566 B2 * 7/2015 Czimmek ..... F02M 53/06
(Continued)

FOREIGN PATENT DOCUMENTS

DE 19952344 A1 5/2001
JP 2004-316520 A 11/2004
(Continued)

*Primary Examiner* — Thomas Moulis
*Assistant Examiner* — John Bailey
(74) *Attorney, Agent, or Firm* — Andrews Kurth Kenyon LLP

(57) ABSTRACT

A fuel injection system in the present invention is provided with a fuel injection valve (10) which incorporates a heater (20) for heating fuel before being injected. The temperature of the heater (20) is estimated on the basis of the resistance value $R_{Htr}$ of the heater (20). The temperature of the heater (20) estimated at or after the time of occurrence of a point of inflection in the resistance value $R_{Htr}$ of the heater (20) is corrected in order to reduce to zero the difference between the nucleate boiling start point temperature and the estimated temperature value of the heater (20) at the time of occurrence of the point of inflection.

3 Claims, 3 Drawing Sheets

(56) References Cited

U.S. PATENT DOCUMENTS

| | | | | |
|---|---|---|---|---|
| 2002/0071974 | A1* | 6/2002 | Yamaoka | B01J 19/0006 429/423 |
| 2007/0193852 | A1* | 8/2007 | Ashford | C10G 7/02 196/132 |
| 2007/0221874 | A1* | 9/2007 | Hornby | F02M 51/0617 251/129.09 |
| 2007/0235557 | A1* | 10/2007 | Hornby | F02M 51/0671 239/135 |
| 2008/0223346 | A1* | 9/2008 | Hornby | F02M 51/061 123/549 |
| 2009/0294552 | A1* | 12/2009 | Trapasso | F02M 51/061 239/132 |
| 2010/0133363 | A1* | 6/2010 | Imoehl | F02M 51/0671 239/585.1 |
| 2012/0060935 | A1* | 3/2012 | Carter | F02M 21/0221 137/14 |
| 2012/0267448 | A1* | 10/2012 | Czimmek | F02M 53/06 239/128 |
| 2013/0118458 | A1* | 5/2013 | Kojima | F02D 19/022 123/552 |
| 2013/0308378 | A1* | 11/2013 | Manaka | G01K 7/16 365/163 |
| 2014/0116394 | A1* | 5/2014 | Kosuge | F02M 21/0212 123/472 |

FOREIGN PATENT DOCUMENTS

| | | | |
|---|---|---|---|
| JP | 2012-26404 | A | 2/2012 |
| WO | 2012/014333 | A1 | 2/2012 |

* cited by examiner

[Fig. 1]
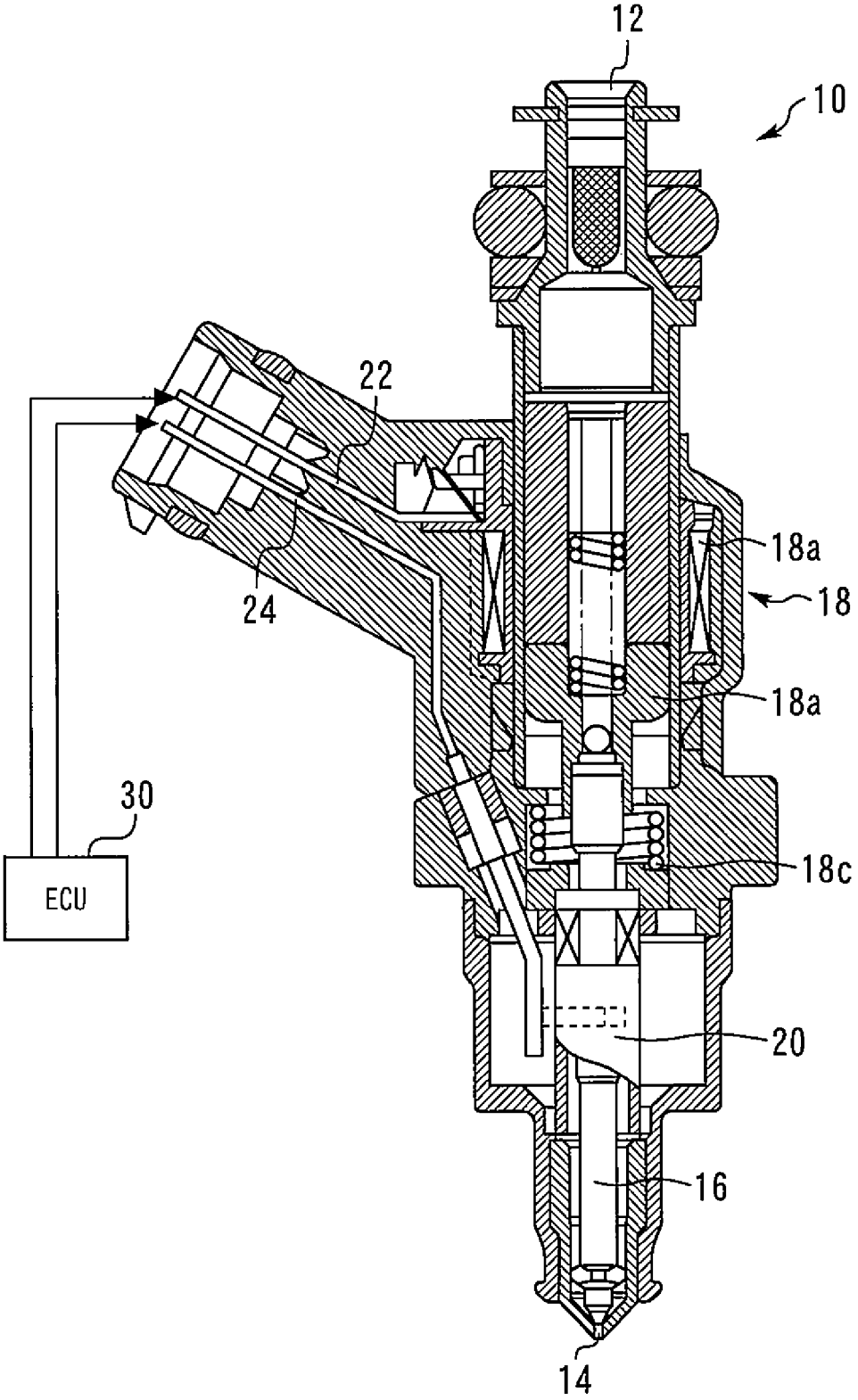

[Fig. 2]
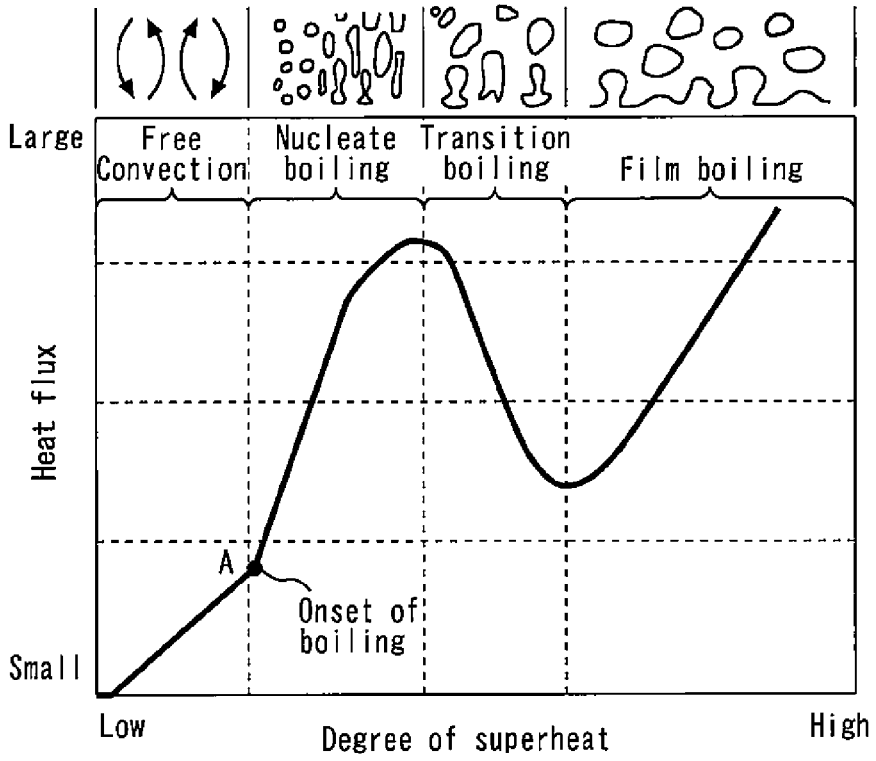
[Fig. 3]
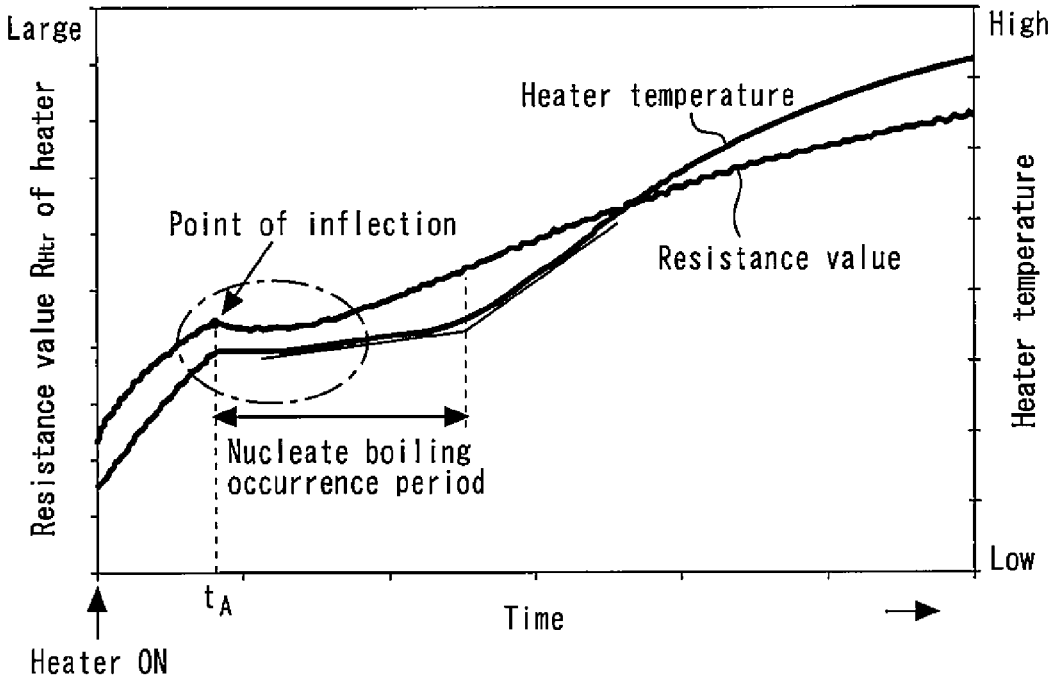

[Fig. 4]
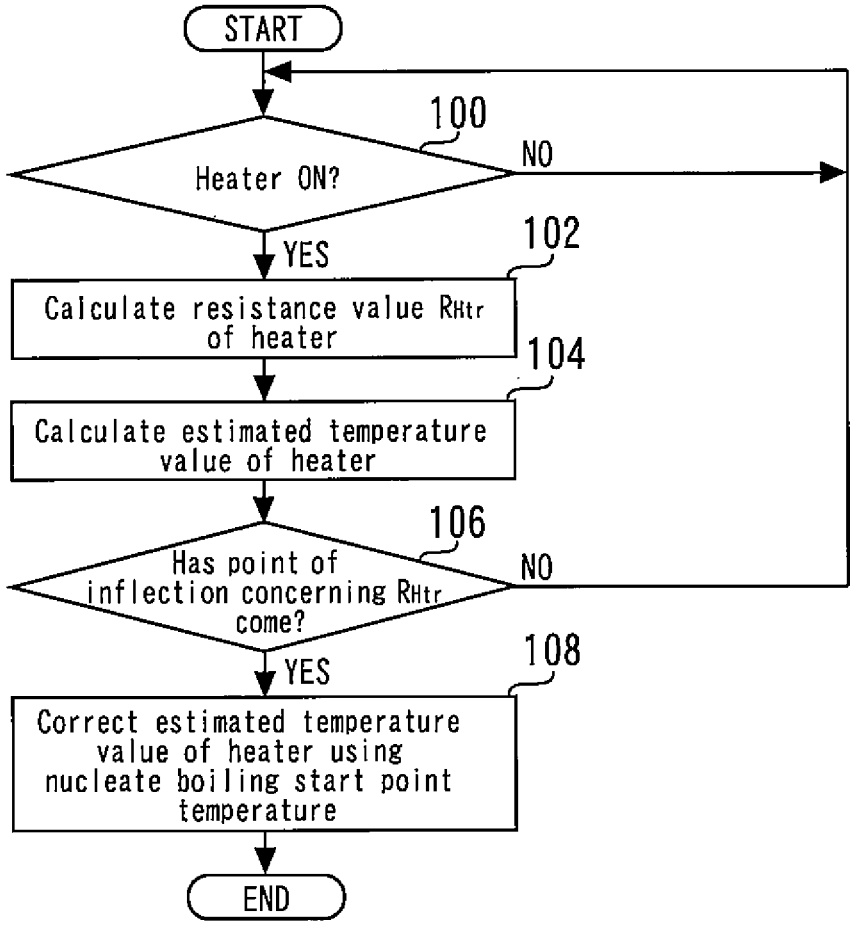

FUEL INJECTION SYSTEM

CROSS-REFERENCE TO RELATED APPLICATION

This is a national phase application based on the PCT International Patent Application No. PCT/JP2012/068861 filed Jul. 25, 2012, the entire contents of which are incorporated herein by reference.

TECHNICAL FIELD

The present invention relates to a fuel injection system, and more particular to a fuel injection system which includes a heater for heating fuel before being injected from a fuel injection valve.

BACKGROUND ART

So far, for example, Patent Document 1 discloses a fuel injection system for an internal combustion engine. A fuel injection valve in this conventional system incorporates a heater for heating fuel immediately before being injected. This heater is configured to produce heat by receiving a supply of electric power from a predetermined electric power source. In the aforementioned fuel injection valve, the resistance value of the heater is set to a value within a predetermined range so that the surface temperature of the heater falls within a predetermined temperature range in which a deposit does not adhere.

The temperature of the heater can be estimated on the basis of an unambiguous relationship with the resistance value of the heater. In addition, the resistance value of the heater can be calculated on the basis of electric voltage that is applied to the heater (voltage between both ends of the heater) and electric current that flows through the heater. However, an error may be produced in the estimated temperature value of the heater due to factors of variations concerning its hardware (for example, a variation in the resistance value of the heater, and a variation in the resistance value of a wire harness that supplies the heater with electric power).

CITATION LIST

Patent Document

Patent Document 1: Japanese Laid-open Patent Application Publication No. 2004-316520

SUMMARY OF INVENTION

The present invention has been made to solve the problem as described above, and has its object to provide a fuel injection system that includes a fuel injection valve in which fuel is heated by a heater before being injected and that can favorably improve the estimation accuracy of the heater temperature.

The present invention is a fuel injection system, which includes a fuel injection valve, a heater, heater temperature estimation means and heater temperature correction means. The fuel injection valve is configured to inject fuel. The heater is configured to receive a supply of electric power from a predetermined power source and heats fuel before the fuel is injected from the fuel injection valve. The heater temperature estimation means estimates the temperature of the heater on the basis of the resistance value of the heater.

The heater temperature correction means corrects the temperature of the heater estimated by the heater temperature estimation means so that the difference between the nucleate boiling start point temperature of the fuel and an estimated temperature value of the heater at the time of occurrence of a point of inflection in the resistance value of the heater after energization to the heater is started is reduced.

When the nucleate boiling start point in which nucleate boiling starts to occur in the fuel that is heated by the heater comes, a point of inflection occurs in the resistance value of the heater. In addition, the nucleate boiling start point temperature of fuel is unambiguously defined on the basis of fuel property and fuel pressure. According to the present invention, the temperature of the heater estimated by the heater temperature estimation means is corrected in order to reduce the difference between the nucleate boiling start point temperature of the fuel and an estimated temperature value of the heater at the time of occurrence of the point of inflection in the resistance value of the heater after energization to the heater is started. This can properly correct an estimation error of the heater temperature that may be produced due to factors of variations concerning the hardware, when the point of inflection in the resistance value of the heater comes, that is to say, when the nucleate boiling start point comes. In addition, the estimation accuracy of the heater temperature can be enhanced by performing such correction processing of the estimated heater temperature value.

Moreover, the heater temperature correction means in the present invention may provide a correction to reduce the difference with respect to the temperature of the heater estimated by the heater temperature estimation means at or after the time of occurrence of the point of inflection. According to such configuration, the correction for the heater temperature in the present invention is continuously performed with respect to the heater temperature estimated by the heater temperature estimation means at or after the time of occurrence of the aforementioned point of inflection. This can efficiently enhance the estimation accuracy of the heater temperature.

Furthermore, the correction performed by the heater temperature correction means in the present invention may correct the temperature of the heater estimated by the heater temperature estimation means so as to reduce the difference to zero. According to such configuration, a correction to reduce to zero the aforementioned difference is performed at the time of occurrence of the point of inflection in the resistance value of the heater, as a preferred manner of the correction of the heater temperature in the present invention. This can efficiently enhance the estimation accuracy of the heater temperature.

BRIEF DESCRIPTION OF DRAWINGS

FIG. 1 is a diagram for explaining a configuration of the main part of a fuel injection system according to a first embodiment of the present invention;

FIG. 2 is a diagram showing the boiling curve of fuel;

FIG. 3 is a diagram illustrating a time change of the resistance value $R_{Htr}$ and temperature of a heater after energization to the heater is started; and FIG. 4 is a flowchart of a routine that is executed in the first embodiment of the present invention.

DESCRIPTION OF EMBODIMENT

First Embodiment

FIG. 1 is a diagram for explaining a configuration of the main part of a fuel injection system according to a first embodiment of the present invention.

The fuel injection system of the present embodiment includes a fuel injection valve 10 as shown in FIG. 1. The fuel injection valve 10 is used to inject fuel with respect to a combustion chamber or an intake passage of an internal combustion engine. Fuel pressurized by a fuel pump (not shown) is supplied to the fuel injection valve 10 from a fuel inlet 12. The fuel injection valve 10 is formed into a substantially cylindrical shape, and the fuel that was supplied from its one end (fuel inlet 12) is injected from a nozzle hole 14 formed at the other end after flowing through the inside of the fuel injection valve 10.

A needle vale 16 is accommodated in the fuel injection valve 10 so as to be movable in its axial direction. The needle valve 16 is driven by an electro-magnetic drive unit 18 to move in the axial direction and, as a result, the nozzle hole 14 opens and closes. The electro-magnetic drive unit 18 includes, as main constituent parts, an electro-magnetic coil 18*a*, an armature 18*b* and a compression spring 18*c*.

Further, a heater 20 is incorporated into the fuel injection valve 10 at a location at which the heater 20 comes into contact with fuel that flows through a fuel flow passage that is formed into the fuel injection valve 10. The heater 20 receives a supply of electric power from a predetermined electric power source (for example, a battery of a vehicle in which an internal combustion engine having the fuel injection valve 10 is mounted), and includes a heat resistive element having characteristics (PTC (Positive Temperature Coefficient)) that when its temperature increases, its electric resistance value increases.

The system shown in FIG. 1 includes an Electronic Control Unit (ECU) 30. The ECU 30 is configured as a known micro computer in which a ROM, a RAM, a CPU, input ports and output ports that are not shown are connected with one another by interactive buses. The ECU 30 uses the electric power source, such as the aforementioned battery, to start or stop the energization to a terminal 22 of the fuel injection valve 10 and thereby controls time period of the energization to the fuel injection valve 10. In addition, the ECU 30 uses the electric power source, such as the aforementioned battery, to pass electric current through the heater 20 via a conducting terminal 24 over a predetermined time period and thereby supplies a predetermined amount of electric power. More specifically, the ECU 30 reads signals of various sensors (not shown) that detect the operational state of the internal combustion engine (for example, an engine speed, intake air amount and cooling water temperature), and controls the energization of the fuel injection valve 10 and the energization of the heater 20 in accordance with predetermined programs.

As described so far, the fuel injection valve 10 of the present embodiment is configured so that fuel is heated by the built-in heater 20 immediately before being injected from the nozzle hole 14. For example, the ECU 30 starts the energization of the heater 20 when detecting an operation of an ignition switch (not shown) to an ON state at the time of a cold start of the internal combustion engine. If fuel injection by the fuel injection valve 10 is performed in a state in which such energization to the heater 20 has been made, fuel that flows through the inside of the fuel injection valve 10 is injected from the nozzle hole 14 after the fuel is heated by the heater 20. Injecting the heated fuel from the nozzle hole 14 can boost fuel atomization (nebulization). This makes it possible to sufficiently reduce exhaust emissions.

Next, an estimation method for the heater temperature based on the resistance value $R_{HTR}$ of the heater 20 will be described.

To the heater 20, a drive voltage (herein, a battery voltage as one example) is applied via a wire harness (electric wires) that are not shown. It is assumed that a part of the wire harness includes the aforementioned conducting terminal 24. The ECU 30 is configured so as to be able to detect two inputs, that is, the battery voltage and a voltage drop $V_{WH}$ in the wire harness as a whole. The electric resistance value of the wire harness as a whole is referred to as $R_{WH}$. The electric resistance value $R_{WH}$ itself is stored in the ECU 30 as a design value. The ECU 30 use the electric resistance value $R_{WH}$ as a so-called shunt resistance, and calculates electric current I that flows through the heater 20 on the basis of the voltage drop $V_{WH}$.

Furthermore, the ECU 30 calculates the resistance value of the heater 20 (the internal resistance value) $R_{Htr}$ on the basis of the calculated electric current value I and the electric voltage $V_{Htr}$ between both ends of the heater 20 (the value obtained by subtracting the voltage drop $V_{WH}$ from the battery voltage). There exists an unambiguous relationship between the resistance value $R_{Htr}$ and temperature of the heater 20. The ECU 30 stores such relationship. Therefore, the ECU 30 can calculate the estimated temperature value of the heater on the basis of such relationship and the calculated resistance value $R_{Htr}$ of the heater 20.

FIG. 2 is a diagram showing the boiling curve of fuel. More specifically, FIG. 2 represents boiling phenomena of fuel that is liquid, with a relationship between the heat flux between a heat transfer surface (the surface of the heater 20) and fuel, and the difference (degree of superheat) of the temperature of the heat transfer surface (the surface temperature of the heater 20) with respect to the saturated temperature (boiling point) of liquid.

When fuel is heated by the heater 20 incorporated into the fuel injection valve 10, the state of boiling of the fuel changes in accordance with the degree of superheat (the difference between the surface temperature of the heater 20 and the boiling point of the fuel). Specifically, as a result of the heating of fuel by the heater 20 progressing in a non boiling range with natural convection at the initial stage of the heating (a range indicated "Free Convection" in FIG. 2), the temperature of the heat transfer surface reaches the nucleate boiling start point A and a nucleate boiling range is reached. When entering the nucleate boiling range, heat flux rapidly increases as shown in FIG. 2. When the heat flux exceeds the nucleate boiling start point A, the heat supplied to the heater 20 becomes easy to be transferred to fuel. Because of this, in order to efficiently warm up the fuel using less energy, it can be said what is most effective is to use the nucleate boiling range in which heat flux is large. In addition, in order to efficiently use the nucleate boiling range, it is required to control the temperature (surface temperature) of the heater 20 within a temperature range in which nucleate boiling occurs.

According to the above described estimation method, the estimated temperature value of the heater can be calculated on the basis of the resistance value $R_{Htr}$ of the heater 20. However, the enerzation path of the heater 20 has factors of variations concerning its hardware (such as a variation in the resistance value $R_{Htr}$ of the heater 20 and a variation in the resistance value $R_{WH}$ in the aforementioned wire harness). Due to such factors of the variation, a variation may be arisen to the electric current I or the resistance value $R_{Htr}$ of the heater 20 calculated as described above. As a result of this, an error may be arisen to the estimated value of the heater temperature.

To prevent the heater 20 from being overheated when controlling the heater temperature in order to use the nucleate boiling region, it is needed to assume a situation in which the actual heater temperature becomes higher than the estimated value due to an estimation error as described above. As a result, it is needed to control the heater temperature within a lower temperature range, and therefore, it becomes difficult to use the nucleate boiling region wider (up to nearly the upper limit). Accordingly, in the present embodiment, the following correction is made with respect to the heater temperature that is estimated using the above described method during use of the heater 20 in order to increase the estimation accuracy of the heater temperature.

FIG. 3 is a diagram illustrating a time change of the resistance value $R_{Htr}$ and temperature of the heater 20 after the energization to the heater 20 is started.

A time point $t_A$ in FIG. 3 shows a timing at which the nucleate boiling start point (Onset of Nucleate Boiling) A comes after the energization to the heater 20 is started. As described above, if heat flux increases beyond the nucleate boiling start point A, the heat that the heater 20 received becomes easy to be transferred to fuel. As a result of this, an increase in temperature of the heater 20 slows down (stagnates) during a nucleate boiling occurrence period after the time point $t_A$ comes, as shown in FIG. 3. In addition, when the time point $t_A$ in which such stagnation (plateau) of a temperature increase in the heater 20 occurs comes, as shown in FIG. 3, a point of inflection appears on a time change curve of the resistance value $R_{Htr}$ of the heater 20 after the energization to the heater 20 is started.

Accordingly, in the present embodiment, it is determined that when a point of inflection (first point of inflection) on a time change curve of the resistance value $R_{Htr}$ calculated for estimation of the heater temperature is detected after the energization to the heater 20 is started, the nucleate boiling start point A in which nucleate boiling starts to occur in the fuel heated by the heater 20 has come. The estimated value of the heater temperature at the time of this determination is herein referred to as an "estimated heater temperature value at the time of nucleate boiling start". In the present embodiment, when the aforementioned determination is made, the heater temperature that is estimated at or after the time of occurrence of the point of inflection in the resistance value $R_{Htr}$ of the heater 20 (the time of determining that the nucleate boiling start point A has come) is corrected in order to reduce to zero the difference (deviation amount) of the estimated heater temperature value at the time of nucleate boiling start with respect to the temperature of fuel at the nucleate boiling start point A (hereinafter, referred to as a "nucleate boiling start point temperature").

FIG. 4 is a flowchart that shows a routine executed by the ECU 30 to implement a characteristic correction processing for the heater temperature according to the first embodiment of the present invention. It is assumed that the present routine is to be repeatedly executed for every predetermined control period.

As shown in FIG. 4, it is first determined whether or not the heater 20 is in an ON state (whether or not the energization to the heater 20 is being performed) (step 100). As a result of this, if it is determined that the heater 20 is in the ON state, the resistance value $R_{Htr}$ of the heater 20 is calculated by use of the above described method (step 102). Next, the estimated heater temperature value is calculated in accordance with a relationship between the calculated resistance value $R_{Htr}$, the resistance value $R_{Htr}$ stored in the ECU 30 and the heater temperature (step 104).

Next, it is determined whether or not a point of inflection (which comes first after the start of the energization) has appeared on the time change curve of the resistance value $R_{Htr}$ of the heater 20 that is obtained by being repeatedly calculated after the start of the energization to the heater 20 by use of the processing of the step 102 (step 106). As a result of this, if the determination of present step 106 is not established, the processing at or after step 100 is repeatedly performed.

If, on the other hand, the aforementioned point of inflection is detected in step 106, that is to say, if it can be judged that the nucleate boiling start point A has come, the heater temperature that is estimated at or after the time of determining that the point of inflection in the resistance value $R_{Htr}$ of the heater 20 (the nucleate boiling start point A) has come is corrected in order to reduce to zero the difference of the estimated heater temperature value at the time of nucleate boiling start with respect to the nucleate boiling start point temperature (step 108). More specifically, the correction according to present step 108 is to be performed continuously during a period in which the energization to the heater 20 is performed after the determination of step 106 is established.

The nucleate boiling start point A is unambiguously defined with the type of fuel (that is, the property of the fuel) and fuel pressure. For example, if fuel pressure is about 300 kPa when 100 percent alcohol fuel is used, the nucleate boiling start point temperature becomes about 130 degrees C.

In a case of an internal combustion engine in which the used fuel is fixed by a specific fuel (for example, gasoline) and fuel pressure is set to a predetermined constant value in accordance with the specification of the internal combustion engine, a value stored in advance in the ECU 30 (a value in accordance with a specified fuel type and fuel pressure) is used as the nucleate boiling start point temperature used in present step 108. On the other hand, in a case, for example, of an internal combustion engine mounted in a vehicle in which the property of fuel in a fuel tank may change in accordance with a manner of fueling, such as an internal combustion engine that uses a blended fuel of hydrocarbon fuel and alcohol fuel within an arbitrary blend ratio range, a nucleate boiling start point temperature in accordance with the property of the currently-used fuel that is estimated using an alcohol concentration sensor, an air to fuel ratio sensor or the like is used in present step 108. In addition, in a case of an internal combustion engine capable of changing fuel pressure during operation, a nucleate boiling start point temperature in accordance with the current fuel pressure that is detected by a fuel pressure sensor is used in present step 108.

According to the correction of the heater temperature in present step 108, a heater temperature that has been estimated on the basis of the resistance value $R_{Htr}$ after the energization of the heater 20 is stared is immediately replaced with the nucleate boiling start point temperature (in the aforementioned case, 130 degrees C.), at the time point of arrival of the nucleate boiling start point A. Further, a heater temperature at or after this time point is estimated using a value at the nucleate boiling start point A as its basis. More specifically, if it is assumed that a correction amount necessary for correcting, to the nucleate boiling start point temperature, the estimated heater temperature value at the time point of arrival of the nucleate boiling start point A is X, the heater temperature during a period of the energization to the heater 20 at or after this time point is to be calculated as a value that is obtained by reflecting, with respect to a value that is sequentially estimated on the basis of the resistance value $R_{Htr}$, the aforementioned correction value X.

According to the routine shown in FIG. 4 described so far, it is judged whether or not the nucleate boiling start point A has arrived on the basis of the behavior of the resistance value $R_{Htr}$ of the heater 20 after the energization is started. Further, when a result of such judgment is positive, a correction of the heater temperature in step 108 is performed. Such correction that uses knowledge that the nucleate boiling start point temperature of fuel is unambiguously defined on the basis of fuel property and fuel pressure can properly correct an estimation error of the heater temperature that may be produced due to the above described factors of the variations concerning the hardware, when the nucleate boiling start point A has arrived. In addition, the estimation accuracy of the heater temperature can be enhanced by such correction processing of the estimated heater temperature value. Therefore, fuel can be effectively heated by the heater 20 owing to wide use (up to nearly the upper limit) of the nucleate boiling region. As a result of that, the atomization (nebulization) of fuel can be effectively boosted, and therefore, exhaust emission can be efficiently decreased.

Furthermore, according to the above described routine, the arrival of the nucleate boiling start point A can be accurately judged using knowledge that a point of inflection appears on the time change curve of the resistance value $R_{Htr}$ of the heater 20 at the time of arrival of the nucleate boiling start point A.

Incidentally, in the first embodiment, which has been described above, when the point of inflection in the resistance value $R_{Htr}$ of the heater 20 occurs (when it is determined that the nucleate boiling start point A has arrived), the heater temperature that is estimated at or after the time of occurrence of the point of inflection in the resistance value $R_{Htr}$ of the heater 20 (the time of determining that the nucleate boiling start point A has arrived) is corrected in order to reduce to zero the difference of the estimated heater temperature value at the time of nucleate boiling start with respect to the nucleate boiling start point temperature. However, a correction method of the heater temperature that is estimated by the heater temperature estimation means in the present invention is not limited to the above described method. More specifically, the correction method of the heater temperature in the present invention is not necessarily limited to the one to accurately reduce to zero the aforementioned difference as with the above described method, and may perform a correction to decrease the difference.

Moreover, in the above described first embodiment, a description was made by taking, as one example, a fuel injection valve 10 into which the heater 20 to heat fuel immediately before being injected is incorporated. However, a fuel injection system that is applied to the present invention is not limited to the aforementioned configuration and may, for example, be one in which a heater for heating fuel supplied to a fuel injection valve is provided outside the fuel injection valve.

It is noted that in the first embodiment, which has been described above, the ECU 30 executes the processing of steps 102 and 104, whereby the "heater temperature estimation means" according to the present invention is realized; and the ECU 30 executes the processing of step 108 when the determination result in step 106 is positive, whereby the "heater temperature correction means" according to the present invention is realized.

DESCRIPTION OF SYMBOLS

10 fuel injection valve
12 fuel inlet
14 nozzle hole
16 needle valve
18 electro-magnetic drive unit
18*a* electro-magnetic coil of electro-magnetic drive unit
18*b* armature of electro-magnetic drive unit
18*c* compression spring of electro-magnetic drive unit
20 heater
22 terminal
24 conducting terminal
30 Electronic Control Unit (ECU)

The invention claimed is:

1. A fuel injection system, comprising:

a fuel injection valve configured to inject fuel;

a heater configured to receive a supply of electric power from a predetermined power source and heats fuel before the fuel is injected from the fuel injection valve; and a processor that is programmed to:

estimate a temperature of the heater on a basis of a resistance value of the heater; and correct, based on a relationship between a nucleate boiling start point temperature of the fuel and an estimated temperature value of the heater at a time of occurrence of a point of inflection on a time change curve of the resistance value of the heater after energization to the heater is started, the estimated temperature value of the heater to reduce a difference between the nucleate boiling start point temperature and the estimated temperature value at the time of the occurrence of the point of inflection.

2. The fuel injection system according to claim 1, wherein, to reduce the difference, the processor provides a correction to reduce the difference with respect to the temperature of the heater estimated at or after the time of occurrence of the point of inflection.

3. The fuel injection system according to claim 1, wherein the processor corrects the estimated temperature of the heater so as to reduce the difference to zero.

* * * * *